US007445177B2

(12) United States Patent
Wittmann et al.

(10) Patent No.: US 7,445,177 B2
(45) Date of Patent: Nov. 4, 2008

(54) BOBBIN AND ESPECIALLY A BOBBIN WOUND WITH A YARN

(75) Inventors: Mathias Wittmann, Neusaess (DE); Annette Quaas, Augsburg (DE); Christian Troidl, Schwabmunchen (DE)

(73) Assignee: Amann & Soehne GmbH & Co. KG, Boennigheim (DE)

( * ) Notice: Subject to any disclaimer, the term of this patent is extended or adjusted under 35 U.S.C. 154(b) by 132 days.

(21) Appl. No.: 11/287,481

(22) Filed: Nov. 28, 2005

(65) Prior Publication Data

US 2006/0151650 A1 Jul. 13, 2006

(30) Foreign Application Priority Data

Dec. 2, 2004 (DE) ..... 10 2004 058 325

(51) Int. Cl.
*B65H 75/28* (2006.01)

(52) U.S. Cl. ..... 242/607.1; 242/125.1; 242/476.6

(58) Field of Classification Search ..... 242/172, 242/173, 607, 607.1, 613.1, 118, 125.1, 125, 242/125.2, 613.2, 613, 118.3, 476.4, 476.5, 242/476.6, 480.4, 479.4

See application file for complete search history.

(56) References Cited

U.S. PATENT DOCUMENTS

| | | | | |
|---|---|---|---|---|
| 3,032,292 | A | 5/1962 | Levinson | |
| 3,782,657 | A * | 1/1974 | Nelson | 242/125.1 |
| 4,002,427 | A * | 1/1977 | Moller et al. | 8/155.1 |
| 4,165,055 | A * | 8/1979 | Dee | 242/125.2 |
| 6,595,456 | B2 * | 7/2003 | Rummage | 242/476.6 |

FOREIGN PATENT DOCUMENTS

| | | |
|---|---|---|
| BE | 386132 | 3/1932 |
| DE | 2937016 A1 * | 4/1981 |
| DE | 29719742 | 3/1998 |
| GB | 332936 | 7/1930 |
| GB | 417438 | 10/1934 |
| GB | 1098082 | 1/1968 |

* cited by examiner

*Primary Examiner*—Peter M Cuomo
*Assistant Examiner*—William E Dondero
(74) *Attorney, Agent, or Firm*—Dennison, Schultz & MacDonald

(57) ABSTRACT

A bobbin for receiving a yarn store comprising a winding zone for the yarn and a standing area for the bobbin is described. Here, the winding zone is embodied as conical and the standing area is provided with at least one retaining element for fixing the yarn end.

17 Claims, 1 Drawing Sheet

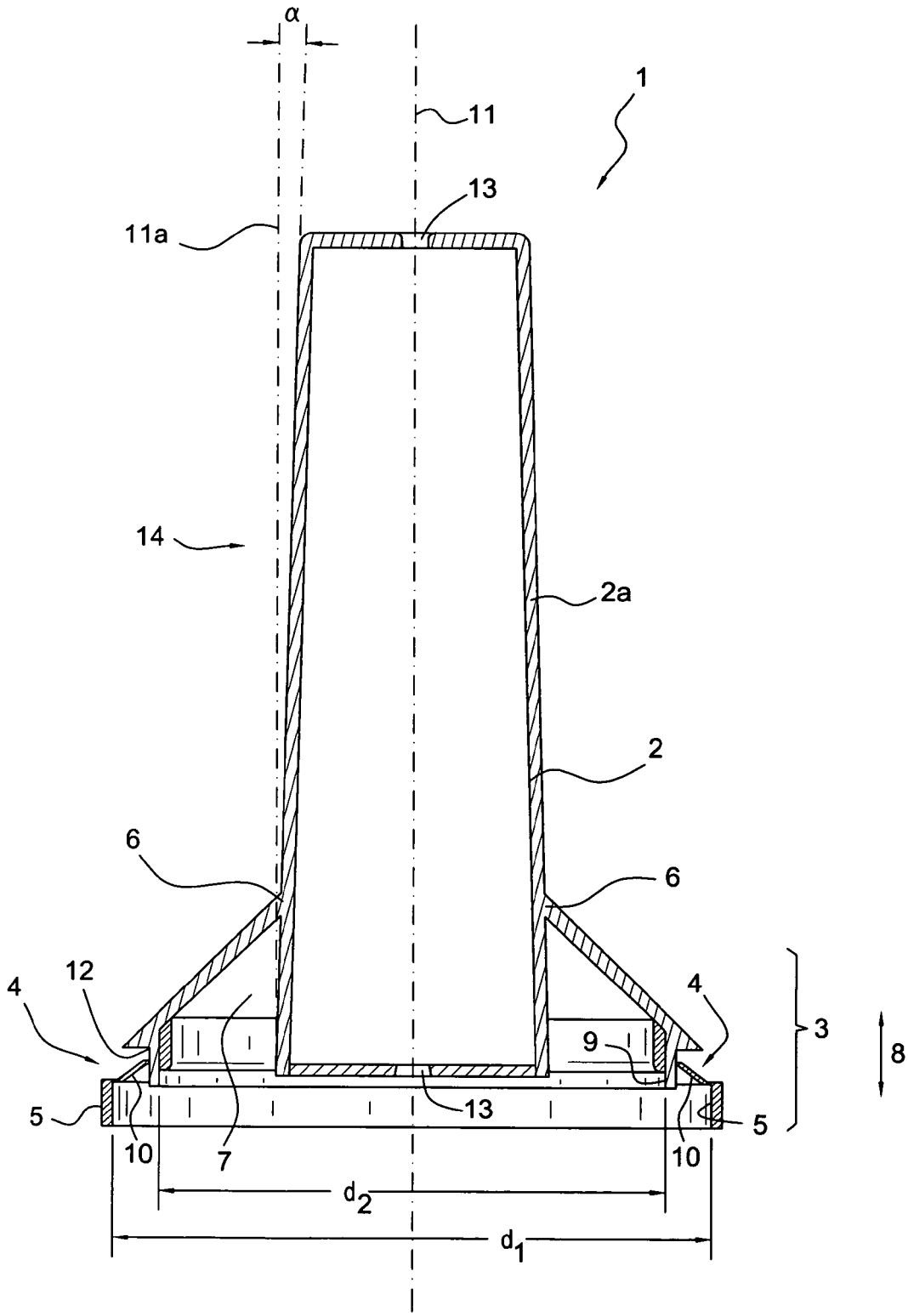
α
1
11
13
11a
14
2a
2
6
6
4
12
4
3
8
9
5
13
5
10
7
10
d2
d1

BOBBIN AND ESPECIALLY A BOBBIN WOUND WITH A YARN

BACKGROUND OF THE INVENTION

The present invention relates to a bobbin and especially to a bobbin wound with a yarn.

In order to supply yarns and especially sewing and embroidery threads, which are preferably present as smooth yarns and especially as multifilament yarns of polyester (polyethylene terephthalate), polyamide 6, polyamide 6.6 and/or mixed yarns of the afore-mentioned synthetic fibers with natural fibers, and which have the structure of doubled, twisted or cabled yarns, to the corresponding sewing or embroidery machines as part of the processing in the garment industry, it is known to wind these sewing or embroidery threads onto bobbins (packages, spools), generally designated as spools having a base (king spools), and use them accordingly.

The previously described known bobbins for receiving yarn supply have a winding zone for the yarn where the relevant yarn is then wound onto the shell of this winding zone especially as a cross-wound precision winding. Furthermore, the known bobbin is provided with a standing area (base-area) so that the bobbin can be used and stored vertically and therefore standing upright during and after usage.

Since the winding zone of the known bobbin is embodied as a cylindrical core, the problem frequently arises that, as a result of their relatively smooth surface, the highly twisted or doubled multifilament yarns wound on the shell (casing) of the winding zone possess poor positional adhesion with the result that during usage of the known bobbin, the outer yarn layers become displaced relative to the layers located thereunder. This layer fall-off can result in a partial or complete overlapping of the outer yarn layers by the inner yarn layers. This in turn prevents the yarn from being drawn off from the king spool with uniform tension and further results in a jerkily draw-off of the loosened and entangled yarns which ultimately causes a thread break and therefore considerable disturbance of production during sewing or embroidery.

SUMMARY OF THE INVENTION

It is the object of the invention to provide a bobbin (package, spool), which is generally also designated as a king spool, meaning a spool having a base-area, of the specified type which allows the yarn wound thereon to be drawn off under uniform tension during the sewing or embroidery process and which further ensures that when a bobbin is changed, the yarns wound hereon do not undergo any undesirable positional displacement.

The present object is solved by the bobbin according to the invention.

The bobbin (package, spool) according to the invention for receiving a yarn feed provides a winding zone for the yarn and a standing area for the bobbin, wherein in the bobbin according to the invention the winding zone is embodied as conical and furthermore, at least one retaining element for fixing the yarn end is associated with the standing area. Since the bobbin according to the invention has a conically configured winding zone, the bobbin according to the invention prevents the previously described displacement of the yarn layers relative to one another from being able to occur during usage of the bobbin and thus during sewing or embroidery so that in consequence, no overlapping of the inner yarn layers and the outer yarn layers takes place. This in turn prevents any hooking of the overlapping or loosened yarns from occurring in the bobbin according to the invention. This has the result that during the sewing or embroidery process the yarn can be drawn off from the bobbin according to the invention with uniform tension avoiding any tension peaks so that thread breaks are accordingly also prevented and thus disturbances of the process are avoided. If a yarn change is to be carried out during the production sequence in the clothing industry or embroidery, in the bobbin according to the invention which is to be exchanged, the yarn end can be fixed by the retaining element associated with the standing area so that in this case, the yarn end is held under tension relative to the next yarn area wound on the shell of the winding zone which, during storage of the correspondingly used bobbin, prevents the previously described undesirable yarn displacement from taking place. The bobbin thus stored can then be reused without any difficulty in a renewed yarn change without hooking of loosened yarn layers taking place. A yarn end thus fixed thus brings about secure transport of the wound bobbin according to the invention.

The bobbin according to the invention has a number of further advantages. Firstly, it can be noted that when yarns, especially sewing and embroidery yarns, are drawn off from the bobbin according to the invention, wound with these yarns, uniform tensions always result and for the reasons specified previously, tension peaks are avoided which can first be seen in a perturbation-free production sequence, i.e., down times caused by yarn breaks do not occur with the bobbin according to the invention. Furthermore, as a result of using the bobbin according to the invention wound with yarn, the seam construction diagram or the embroidery pattern become more uniform since an identical yarn length is always made available over the same sewing or embroidery lengths as a result of the uniform application of tension during drawing-off the yarn and thus as a result of this constant tension. As a result of making the draw-off tension uniform, when the bobbin wound with yarn according to the invention is used, no subsequent sagging or crimping of seams or undesirable ejection of zones of the embroidery occurs, which is particularly significant when the fully-fashioned or embroidered parts are subjected to subsequent care treatment such as, for example, washing at elevated temperature or an ironing process. Since in the bobbin according to the invention, at least one retaining element for fixing the yarn end is associated with the standing area, a partly processed yarn residual supply can be stored particularly reliably on the bobbin according to the invention since the yarn end is fixed by the yarn retaining element in this case and thus the undesirable variation of the yarn layers described initially in the known bobbin, i.e., the overlapping of the outer yarn layers by the inner yarn layers located thereover cannot occur. Since all yarn layers are thus always reliably fixed both during processing of the bobbin according to the invention and also during storage of residual amounts of yarn or during transport on the bobbin according to the invention, when the bobbin according to the invention, wound with corresponding yarns, is used, no differences in tension occur during drawing-off the yarn so that even the static charge produced by friction of the yarn on deflecting members, which for its part results in charging of the yarn wound on the bobbin according to the invention, cannot have the effect that the spreading and fall-off of the wound yarn layers promoted by the charging occurs in the bobbin according to the invention.

A first, particularly simple embodiment of the bobbin according to the invention, which is particularly inexpensive to manufacture, provides that in this case the winding zone is joined in one piece to the standing area. This embodiment of the bobbin according to the invention on the one hand has a conically shaped winding zone and on the other hand, an arbitrarily shaped standing area where the previously described retaining element for fixing the yarn end is associated with the standing area, which for example is embodied as a clamping slit or as a series of clamping slits. Naturally, the retaining element can also be embodied as an adhesive area so that, instead of the previously described clamping engagement of the yarn end with the retaining element, an adhesive engagement is provided for fixing the yarn end.

For clarification it should be noted that the terms conical or frustro-conical used previously or subsequently always designate a right circular cone section or a right truncated circular cone where in the case of the right circular cone section or a right truncated circular cone, two base circles disposed parallel to one another are always present such that the lower base circle has a larger diameter in relation to the upper base circle.

In order to ensure reliable stability of the bobbin according to the invention, another embodiment of the bobbin according to the invention provides in this case the standing area comprises a lower, cylindrical standing section and a frustro-conical section cooperating therewith. In particular, in this embodiment the frustro-conical section disposed above the cylindrical standing section represents a stiffening element for the winding zone affixed thereon whereby it is ensured on the one hand that this embodiment of the bobbin according to the invention has a high stability towards mechanical stresses and a good standing capacity and on the other hand, any undesirable displacement of the yarn layers (relative to one another) cannot occur.

If in the previously described embodiment of the bobbin according to the invention, the cylindrical standing section is provided with a larger diameter compared to the base circle of the frustro-conical section pointing toward the standing section, so that when viewed radially, the standing section projects over the lower base circle of the frustro-conical section , this projection area of the cylindrical standing section can form an intercepting area for a yarn end which then preferably has an effect when a bobbin change is required during processing of the bobbin according to the invention wound with the yarn.

In a further development of the previously described embodiment of the bobbin according to the invention, the frustro-conical section is constructed in one piece with the winding zone such that the conical winding zone passes through the base circle having the smaller radius of the frustro-conical section and penetrates at least partly into the interior of the frustro-conical section so that the standing capacity is accordingly hereby increased and the stiffening of the winding zone is improved. In addition, such an embodiment can be manufactured particularly inexpensively because of the one-piece design of the conical winding zone and the frustro-conical section.

In another further development of the previously described embodiment of the bobbin according to the invention, the cylindrical standing section is axially displaceable relative to the frustro-conical section so that on contact of the cylindrical standing section with the frustro-conical section, the retaining element for fixing the yarn element is formed. In other words, the conical winding zone and the frustro-conical section are movable jointly, especially axially displaceable, from a first position in which the cylindrical standing section is located in contact with a lower portion of the frustro-conical section and holds the yarn end inserted herebetween by clamping engagement, and a second position in which the previously described contact between a lower portion of the frustro-conical section and the cylindrical standing section does not exist and in which the yarn end securely clamped in the first position is released. In this way, when the bobbin wound with the yarn according to the invention is not used or during transport, the relevant yarn end can be fixed or the fixing thus made can be released again very simply and quickly since only an axial displacement of the frustro-conical section and the winding zone associated therewith relative to the cylindrical standing section is required.

In order to configure the previously described axial displacement of the cylindrical standing section on the one hand relative to the frustro-conical section and the conical winding zone associated preferably in one piece therewith especially simply and durably, a further embodiment of the bobbin according to the invention provides that the diameter of the cylindrical standing section is greater than the diameter of the base circle having the larger radius of the frustro-conical section. Furthermore, a radially inwardly set-back ring element is provided on the foot side on the frustro-conical section wherein the cylindrical standing section is provided with a guide element at its end pointing towards the frustro-conical section which retains the ring element axially displaceably in a force- and/or form-locking fashion. In particular, this guide element is elastically prestressed against the ring element so that it clamps the ring element over its entire axial casing length when the winding zone and the frustro-conical section associated therewith is displaced relative to the standing section from the previously described first position into the second position and from the second position into the first position. In order to prevent undesirable releasing of the standing section from the frustro-conical section during the axial displacement and thus cancel the previously described force- and/or form-locking engagement, the guide element or the ring element is preferably provided with a corresponding locking element. Naturally, however it is also possible to allocate a correspondingly shaped guide element to the frustro-conical section and a ring element cooperating accordingly herewith to the standing section wherein in this embodiment also, the ring element and the guide element are in force- and/or form-locking engagement. Another embodiment which also allows an axial displacement of the standing section relative to the winding zone provides that in this case, the standing element has a centered upper cylindrical section, this centered upper cylindrical section having a radius smaller than the radius of the lower area of the conical winding zone. In this case, the hollow-constructed conical winding zone thus receives the corresponding upper cylindrical region of the standing section and retains this axially displaceably by force- and/or form-locking engagement.

The standing section can thus be screwed to the winding zone where the thread provided here then serves at the same time as a retaining element for the yarn end since it forms a clamping gap to receive the yarn end.

Basically, with regard to the circumferential surface of the conical winding zone, it should be noted that the conicity is configured so as to ensure the initially described adhesion of the yarn layers. It was surprisingly established that problem-free retention of the yarn layer secure from slippage can especially be achieved if the cone angle a is relatively small, i.e., if this cone angle $\alpha$ varies between 0.5° and 6°, and preferably between 1.5° and 3°, where this cone angle defines the deviation of the shell axis in the direction of the central axis. In other words, the winding zone is constructed to that the radius of the lower base circle which points toward the standing section, is greater than the radius of the upper base circle running parallel hereto so that the winding zone accordingly tapers conically from the standing section toward the head side of the bobbin.

In order to ensure in the previously described embodiments of the bobbin according to the invention a particularly reliable retention especially of the first (lower) yarn layers wound on the winding zone, which can thus mean overall a very good basis for problem-free complete winding of the bobbin according to the invention with yarn, an advantageous embodiment of the bobbin according to the invention provides that in this case, the shell (casing) of the conical winding zone is provided with a rough surface. In order to provide this rough circumferential surface of the conical winding zone, the conical winding zone can in particular be provided with a corresponding plurality of projecting element, such as for example, punctiform and projecting elements or the circumferential surface can be suitably roughened or etched by mechanical or chemical treatment. At the same time, it is hereby ensure that at the beginning of winding the yarn on the winding zone and when creating the first (lower) yarn layer, the yarn itself can also be wound without substantial slippage on the winding zone if this yarn has a particularly smooth surface which is especially the case with highly twisted or doubled and/or coated yarns.

It has already been stated hereinbefore that the retaining element associated with the foot region for fixing the yarn end during transport or during storage of the bobbin is embodied as at least one slit, where in the simplest case this slit is configured as a V-shaped slit. It is likewise possible to configure the retaining element for fixing the yarn end so as described previously in the embodiments of the bobbin according to the invention, where the winding zone is axially displaceable relative to the standing section between the first position and the second position.

In another embodiment of the bobbin according to the invention, the retaining element for fixing the yarn end is embodied as an adhesive surface where this adhesive surface consists of a permanent adhesive so that the yarn end is adhered fixedly hereon. This adhesive surface is then preferably positioned so that it is provided at such a location of the bobbin that it is protected during transport, storage and/or during usage.

In order to give the bobbin according to the invention a comparatively low weight, it is possible to construct all the bobbin parts or individual bobbin parts and especially the conical winding zone and/or the standing area and/or the previously described frustro-conical section as hollow members.

A particularly suitable embodiment of the bobbin according to the invention having reduced weight and nevertheless the required stability provides that under a central radial load of 15 N/mm$^2$, the conical winding zone exhibits a deflection (bending) of less than 0.2 mm, preferably a deflection (bending) between 0.2 mm and 0.1 mm. It has been shown that even under extremely high winding stresses, such a winding zone has the necessary deformation rigidity to produce the bobbin wound with yarn so that a problem-free bobbin according to the invention wound with yarn can be created even when the winding zone is embodied as a hollow member.

As has been stated hereinbefore, to save weight the bobbin is preferably constructed entirely as a hollow member where, in addition to the previously described deflection stiffness, the bobbin according to the invention further in particular has a ratio of axial length of the winding zone to its average diameter between 1:0.15 and 1:0.4. In this case, the average diameter of the conical winding zone is calculated from the total of the diameter of the lower base circle and the upper base circle divided by 2.

In order to reliably position the bobbin according to the invention during processing and optionally during storage, an embodiment of the bobbin according to the invention provides that the conical winding zone has respectively one radially centered element, which is preferably a corresponding ring element or for the case where the winding zone is closed at the foot and at the head, a drilled hole where this centered element is used for receiving a mandrel. This mandrel is provided on the corresponding sewing or embroidery machine so that the bobbin according to the invention is held reliably on the mandrel by means of the radially centered element.

The present invention further relates to a bobbin would with a yarn, especially with a sewing thread or an embroidery thread of the constructions described initial so that the winding zone is accordingly provided in this case with a yarn of the previously specified type. In particular in the wound bobbin according to the invention, the yarn is wound on the bobbin as an open or closed precision winding, where an open precision winding means that a small intermediate space exists between adjacent yarns and whereas a closed precision winding implies that adjacent yarns are in contact.

It is especially suitable if the bobbin according to the invention wound with a yarn, has a winding zone whereon the yarn is wound as a closed precision winding, wherein this closed precision winding comprises between 2 crosses/4 sections and 8 crosses/16 sections and especially comprises 3 crosses/6 sections. Here the designation crosses/section gives the ratio of the rotational speed of the bobbin during winding to the lay, where the number of crosses per sections, especially in the case of a wound, slowly turning bobbin, for example, a bobbin which turns at a speed of about 5 m/min, can be identified from visually identifiable and successive annular regions over the axial length of the winding zone.

For the area of usage of the sewing thread and the embroidery thread, the wound bobbin according to the invention is preferably wound such that the yarn winding arranged on the winding zone has a Shore hardness between 50° Sh and 80° Sh, preferably between 60° Sh and 70° Sh.

For the wound bobbin according to the invention, it should basically be noted that the conical winding zone of the bobbin is especially wound with a sewing or knitting thread, wherein the titer of this sewing or embroidery thread is determined according to the respective requirements. The titer of the sewing or embroidery thread wound on the winding zone of the bobbin according to the invention preferably varies between 30 dtex and 1000 dtex, this sewing or embroidery thread being preferably a highly twisted, cabled, doubled yarn and/or coated yarn.

Particular reliable retention of the yarn layers with respect to an axial displacement on the conical winding zone is achieved with a wound bobbin according to the invention if the conical winding zone of the bobbin is wound with a yarn length between 1000 m and 10,000 m, preferably between 4000 m and 8000 m depending on the respective titer of the sewing or embroidery thread wound thereon.

In order to avoid repetitions, it should be noted that all embodiments of the nonwound bobbin described initially according to the invention apply identically especially to the bobbin according to the invention wound with a sewing or embroidery thread, the only difference between the initially described embodiment of the nonwound bobbin according to the invention and the bobbin wound with yarn according to the invention being that in the latter case, a yarn is wound on the winding zone, especially a sewing thread or embroidery thread in the manner described previously, having the construction described previously, the titer described previously, the Shore hardness described previously and/or the yarn length described previously.

Advantageous embodiments of the bobbin according to the invention or the wound bobbin according to the invention are given in the dependent claims.

BRIEF DESCRIPTION OF THE DRAWING

The invention is explained in detail hereinafter with reference to an embodiment of the bobbin in conjunction with the drawing, wherein the single FIGURE in the drawing shows a schematic, axially running sectional view through the bobbin according to the invention, without the winding zone being wound with a yarn.

The single FIGURE in the drawing is a schematic sectional view of a bobbin designated overall as 1. Here the bobbin comprises a conically shaped winding zone 2 and a standing area designated overall as 3 where a retaining element 4 for fixing a yarn end not shown is associated with the standing area. During the production of a bobbin 1 wound with yarn, this yarn, preferably comprising a sewing or embroidery thread, is wound in the manner described previously as an open or closed precision winding on the winding zone 2.

DESCRIPTION OF THE PREFERRED EMBODIMENTS

In the FIGURE the central axis of the bobbin 1 is designated as 11, where a parallel line to this central axis is designated as 11*a*. The conicity of the shell of the winding zone seen relative to the central axis 11 is designated by the angle $\alpha$, where the angle $\alpha$ relative to the straight parallel 11*a* forming a parallel to the central axis 11 has an angle of 2°. In other words, the circumferential surface 2*a* of the winding zone 2 is constructed as slightly inclined to the central axis 11 by the angle $\alpha$.

Provided at the foot of the bobbin 1 is a specially formed standing area 3 which comprising a lower cylindrical standing section 5 and a frustro-conical section 6 cooperating herewith.

As can be seen from the FIGURE, the frustro-conical section 6 is constructed in one piece with the winding zone 2 such that the conical winding zone 2 passes axially through the base circle (not shown) having the smaller radius of the frustro-conical section 6 and thus is almost completely positioned in the interior 7 of the frustro-conical section 6.

In order to achieve a desired axial displacement of the winding zone 2 and the frustro-conical section 6 associated therewith relative to the standing section 5 in the direction of the arrow 8, the diameter d1 of the cylindrical standing section 5 is larger than the diameter d2 of the base circle having the larger radius of the frustro-conical section 6. The inside diameters d1 and d2 are shown in the drawing. Furthermore, a radially inwardly back-springing ring element 9 is provided at the foot on the frustro-conical section 6 whereas the cylindrical standing section has a guide element 10 at its end pointing toward the frustro-conical section 6, which guide element is elastically prestressed toward the ring element 9 and thus holds the ring element 9 axially displaceably in a force-locked manner.

FIG. 1 shows the bobbin 1 in a position where the retaining element 4 fixes no yarn end (not shown). If such a fixing of the yarn end is desired, for example, during transport or intermediate storage of the bobbin 1, this yarn end is positioned so that it rests on the ring element 9 and above the guide element 10, this position being indicated by the reference number 12. As a result of an axial displacement of the winding zone 2 and the frustro-conical section 6 associated therewith toward the cylindrical standing section 5 or as a result of an axial displacement of the cylindrical section 5 toward the frustro-conical section 6 and the winding zone 2 associated therewith, the yarn is clamped at the position designated by 12 and the desired fixing of the yarn end is achieved.

As can be seen from the FIGURE, the bobbin 1 as a whole is embodied as a hollow member. The winding zone 2 further has a centering element embodied as a through hole 13 at the front and the foot, which serves to receive a mandrel of the corresponding sewing or embroidery machine. The desired fixing of the bobbin 1 on the corresponding machine during processing of the yarn wound on the winding zone 2 is hereby accomplished.

If the cylindrical standing section is closed by its lower surface, it is possible to arrange the lower centered element, for example, as a through hole, in this surface.

Under a central load as indicated by the arrow 14, the winding zone 2 has a deflection of 0.15 mm.

The invention claimed is:

1. A bobbin for receiving a yarn reservoir, comprising:

a conical winding zone for the yarn, and a standing area for the bobbin, the bobbin being formed as a hollow member and provided with at least one retaining element for fixing the yarn end, a lower, cylindrical standing section and a frustro-conical section associated therewith, wherein the frustro-conical section is constructed in one piece with the winding zone such that the conical winding zone passes through a base circle having a smaller radius of the frustro-conical section and penetrates at least partly into an interior portion of the frustro-conical section, wherein the cylindrical standing section is axially displaceable relative to the frustro-conical section such that on contact of the cylindrical standing section with the frustro-conical section, the retaining element for fixing the yarn end is formed, and wherein an inside diameter (d1) of the cylindrical standing section is greater than an inside diameter (d2) of a base circle having the larger radius of the frustro-conical section, a radially inwardly directed ring element being provided on a foot side of the frustro-conical section and the cylindrical standing section being provided with a guide element at an end thereof pointing towards the frustro-conical section which retains the ring element axially displaceably in a force- and/or form-locking fashion.

2. The bobbin according to claim 1, wherein the winding zone is connected in one piece to the standing area.

3. The bobbin according to claim 1, wherein the circumferential shell of the conical winding zone is inclined at angle $\alpha$ between 0.5° and 6° relative to the axis.

4. The bobbin according to claim 3, wherein the circumferential shell of the conical winding zone is inclined at angle $\alpha$ between 1.5° and 3° relative to the axis.

5. The bobbin according to claim 1, wherein the shell of the conical winding zone is provided with a rough surface.

6. The bobbin according to claim 1, wherein under a central radial load of 15 N/mm$^2$, the conical winding zone exhibits a deflection of less than 0.2 mm.

7. The bobbin according to claim 6, wherein under a central radial load of 15 N/mm$^2$, the conical winding zone exhibits a deflection of between 0.1 mm and 0.2 mm.

8. The bobbin according to claim 1, having a ratio of axial length to average diameter of the winding zone between 1:0.15 and 1:0.4.

9. The bobbin according to claim 1, wherein the conical winding zone has, respectively, one radially centered element for receiving a mandrel at the foot and at the head.

10. The bobbin according to claim 1, wherein the winding zone is provided with a yarn which is wound on the bobbin as an open or closed precision winding.

11. The bobbin according to claim 10, wherein the winding zone is provided with the yarn as a closed precision winding comprising between 2 crosses/4 sections and 8 crosses/16 sections.

12. The bobbin according to claim 11, wherein the winding zone is provided with the yarn as a closed precision winding comprising 3 crosses/6 sections.

13. The bobbin claim 10, wherein the wound bobbin has a Shore hardness between 50° Sh and 80° Sh.

14. The bobbin claim 13, wherein the Shore hardness of the wound bobbin is between 60° Sh and 70° Sh.

15. The bobbin according to claim 10, wherein the conical winding zone of the bobbin is wound with a sewing or embroidery thread having a titer between 30 dtex and 1000 dtex.

16. The bobbin according to claim 15, wherein the sewing or embroidery thread is a highly twisted or doubled yarn.

17. The bobbin according to claim 10, wherein the conical winding zone of the bobbin is wound with a yarn of length between 1000 m and 10,000 m.

* * * * *